US005779136A

United States Patent [19]

Blazquez Garcia

[11] Patent Number: 5,779,136

[45] Date of Patent: Jul. 14, 1998

[54] CARDBOARD CONTAINER

[76] Inventor: Diego Blazquez Garcia, Olvido 23-3oIzq., E-28026 Madrid, Spain

[21] Appl. No.: 817,550

[22] PCT Filed: Aug. 22, 1996

[86] PCT No.: PCT/ES96/00162

§ 371 Date: Apr. 18, 1997

§ 102(e) Date: Apr. 18, 1997

[87] PCT Pub. No.: WO97/08060

PCT Pub. Date: Mar. 6, 1997

[30] Foreign Application Priority Data

Aug. 22, 1995 [ES] Spain ..... 9502221 U

[51] Int. Cl.[6] ..... B65D 5/50

[52] U.S. Cl. ..... 229/199; 229/918

[58] Field of Search ..... 229/191, 199, 229/918, 919

[56] References Cited

U.S. PATENT DOCUMENTS

| | | | |
|---|---|---|---|
| 3,397,831 | 8/1968 | Adams | 229/199 |
| 4,905,834 | 3/1990 | Gimeno et al. | 229/919 |
| 5,163,611 | 11/1992 | Singer | 229/199 |

FOREIGN PATENT DOCUMENTS

| | | | |
|---|---|---|---|
| 0160929 | 11/1985 | European Pat. Off. . | |
| 2609965 | 7/1988 | France . | |
| 3614233 | 10/1987 | Germany . | |
| 3729596 | 8/1989 | Germany . | |
| 88000753 | 10/1989 | Netherlands | 229/918 |
| 1024806 | 10/1993 | Spain . | |
| 2188036 | 9/1987 | United Kingdom . | |
| 2226546 | 7/1990 | United Kingdom . | |
| 2232404 | 12/1990 | United Kingdom | 229/199 |

*Primary Examiner*—Gary E. Elkins
*Attorney, Agent, or Firm*—Robert M. Schwartz, P.A.; Robert M. Schwartz; Loren D. Pearson

[57] ABSTRACT

It comprises a base sheet, two side walls, two front walls with lateral laps extending therefrom and separated by folding lines, and two reinforcement front walls independent from the base sheet and attached to the front walls. Each reinforcement front wall being composed of a central sheet laterally divided by three folding lines which define a prismatic reinforcement portion with a hollow inside. It also comprises reinforcement supports which are introduced into the hollows of the reinforcement portions, ventilation openings for the products contained, and internal folds in the edges of the side walls of the box which facilitate its handling.

9 Claims, 4 Drawing Sheets

CARDBOARD CONTAINER

BACKGROUND OF THE INVENTION

1. Field of the Invention

The present invention relates to a cardboard container for the transport and storage of products that is designed to provide a consistent and reinforced structure.

2. Description of the Prior Art

Cardboard boxes are known from several embodiments which contemplate their construction starting from a stamped sheet mainly comprising the rectangular base, the side walls or larger sides and the front walls or shorter sides, with longitudinal or lateral extensions of these sides being provided in certain cases in order to define boxes with different shapes.

Boxes are frequently used which have double front walls made up of the front wall itself and its longitudinal extension which also extends upwards and which, once conveniently folded inwards, defines said double wall and guarantees the reinforcement of this sector, said longitudinal extension generally being provided with side laps that attach to the side face, thereby facilitating the cardboard assembly.

In the present case, certain embodiments are contemplated wherein said longitudinal laps may be divided into several sectors which, once conveniently folded, constitute corner reinforcements which allow for improved piling up conditions for the boxes. The folding of these longitudinal extension corner sectors and their attachment to the rest of the box normally involves a certain complexity.

On the other hand, for specific box dimensions, certain problems arise during the manufacturing process as a result of the limitations imposed by the cardboard box plasticizing stage.

Obtaining a carboard box which solves the above problems by incorporating reinforcement side walls which have previously been formed independently from the cardboard sheet, of a size and shape adapted to the container itself, makes the invention proposed hereunder feasible.

SUMMARY OF THE INVENTION

The cardboard container object of this invention is designed to provide a consistent and reinforced structure.

It is the main object of this invention the inclusion of a reinforcement front wall that is independent from the initial box configurating sheet, said reinforcement front wall having prismatic extensions correspondingly located in the box corners to enhance the piling up strength.

It is another object of this invention that the box should be fitted with ventilation holes for the products contained, and internal folds in the edges of the side walls which facilitate its handling.

It is also another object of the invention that the cardboard should be provided with independent reinforcement supports, located in the inner hollow space of the prismatic extensions, designed to improve piling up conditions under special circumstances.

The cardboard container which is the object of the invention is composed of a stamped sheet provided with several folding lines which define the side or larger walls and the front or shorter walls, and corresponding independent reinforcement front walls adhered to the front walls after assembly in a manner that they become perfectly integrated to the overall container, said reinforcement front walls being provided with prismatic portions which enhance the piling up strength of the box.

The container front wall extends laterally to form respective side laps which fold and adhere onto the inner face of the side walls, each lap being provided with an oblique cut in its vertex which defines an edge that coincides with the slanting edge of the oblique cut in the side wall when assembled.

The reinforcement front wall is made up of a central sheet with three folding lines along each of its sides which define two sectors, i.e. an inner and an outer sector, the upper edges of which are slightly raised in respect to the edge of the central sheet and from whose outer sector subsequently extend corresponding lateral lap which reveal a slight staggering along their upper edge, which lap extend on a lower level up to the oblique zone corresponding to the vertex.

Both these sectors, that is, the inner and outer sector, fold inwards to define prismatic reinforcement portions which enhance the piling up strength.

This preformed configuration serves as the basis for performing the subsequent folds of the reinforcement front wall, until it is fitted in the box, so that the inner sector is positioned transversely in the corner and the outer sector is adhered to the raised zone in the lateral lap of the reinforcement front wall itself.

When assembling the reinforcement front wall over the front wall, the central sheet of the former is adhered over the latter, the prismatic portions projecting upwards in respect to the upper edge of the front wall, the reinforcement front wall lateral laps adhering over the inner face of the front wall lateral laps, and the vertical lateral edge of the reinforcement front wall lap abutting in this position against the folded sector of the side wall.

The side walls present respective cuts in the shape of an equilateral triangle between whose vertices extends a folding line, parallel to which, and running outwards, run two other folding lines which define three sectors, the first of which, located between the innermost folding lines, constitutes the upper lateral edge of the box being assembled; the second sector is likewise slantingly folded inwards; and the third sector is adhered to the side wall, thus forming side holding means that can be easily grasped and enable the box to be held and/or transported.

The base sheet presents triangular cuts in each corner which coincide with the position of the prismatic portions and are designed to facilitate the piling up of the boxes, and furthermore incorporates openings shaped as a rhombus in the line separating the side wall from the base sheet which allow for the ventilation of the products contained in the box.

The front walls, as well as the reinforcement front walls, contain partially circular central cutouts along their upper edge which allow the box to be handled with ease.

Reinforcement supports, preferably made of plastic, are incorporated for special piling up requirements which comprise triangular columns incorporated to the hollow space defined inside the prismatic portions of the corners.

These reinforcement supports extend between the upper and lower edges of the box and are shaped in a manner that an ample upper sector of a constant hollow triangular section is provided which constitutes the female portion and receives the reinforcement support of the box piled above it, and another lower, compact and likewise triangular sector of a smaller surface which acts as the male portion.

BRIEF DESCRIPTION OF THE DRAWINGS

In order to complement the description set forth and help toward a better understanding of the characteristics of the invention, a set of drawings is attached to this specification, being an integral part thereof, wherein the following is illustrated with a non-limiting character.

DESCRIPTION OF THE PREFERRED EMBODIMENT

Figure 1:
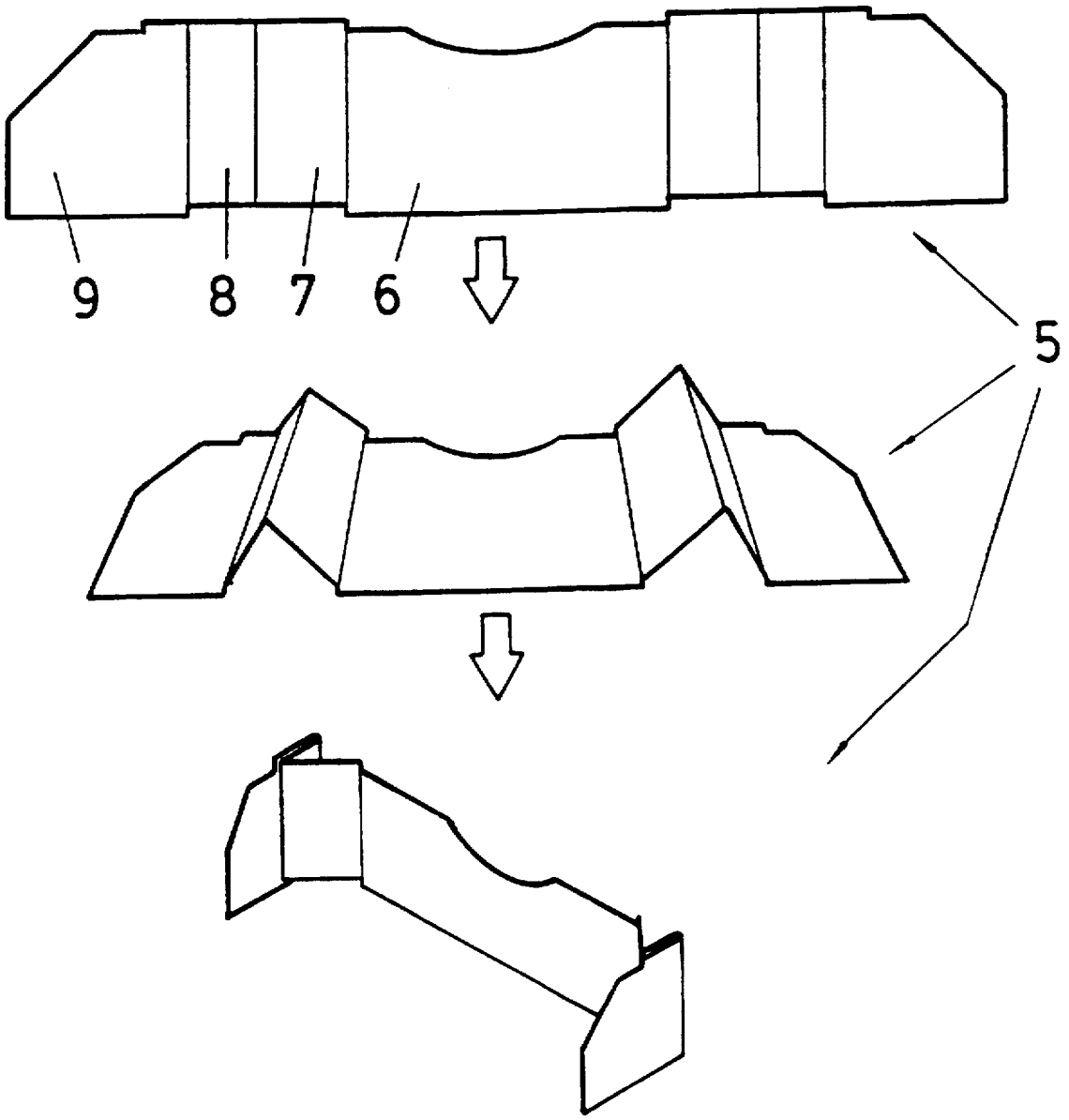
FIG. 1 shows the various reinforcement front wall folding stages.
Figure 2:
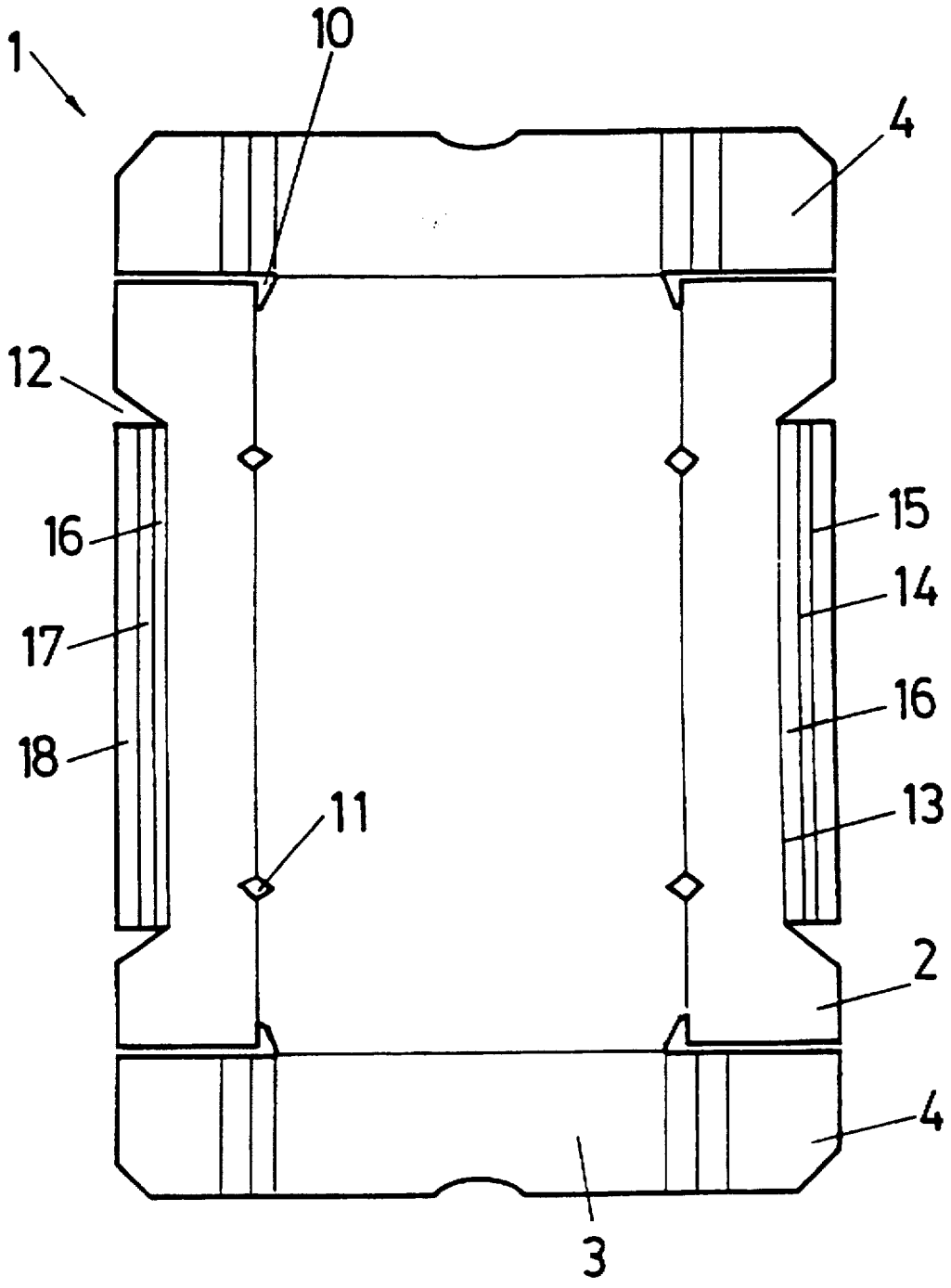
FIG. 2 shows a plan view of the base sheet on which the reinforcement front walls are to be mounted.
Figure 3:
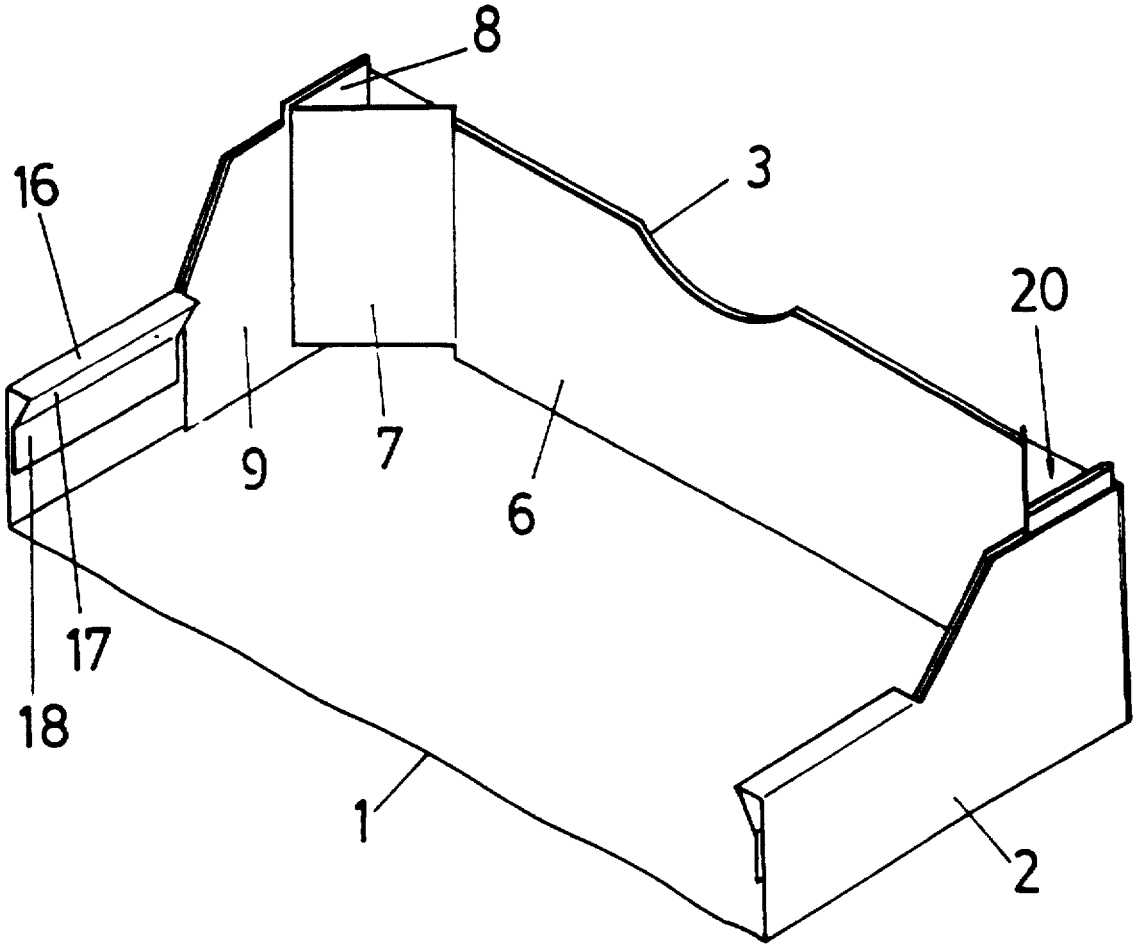
FIG. 3 shows a detailed view of a sector of the box whereon the reinforcement front walls are already mounted.
Figure 4:
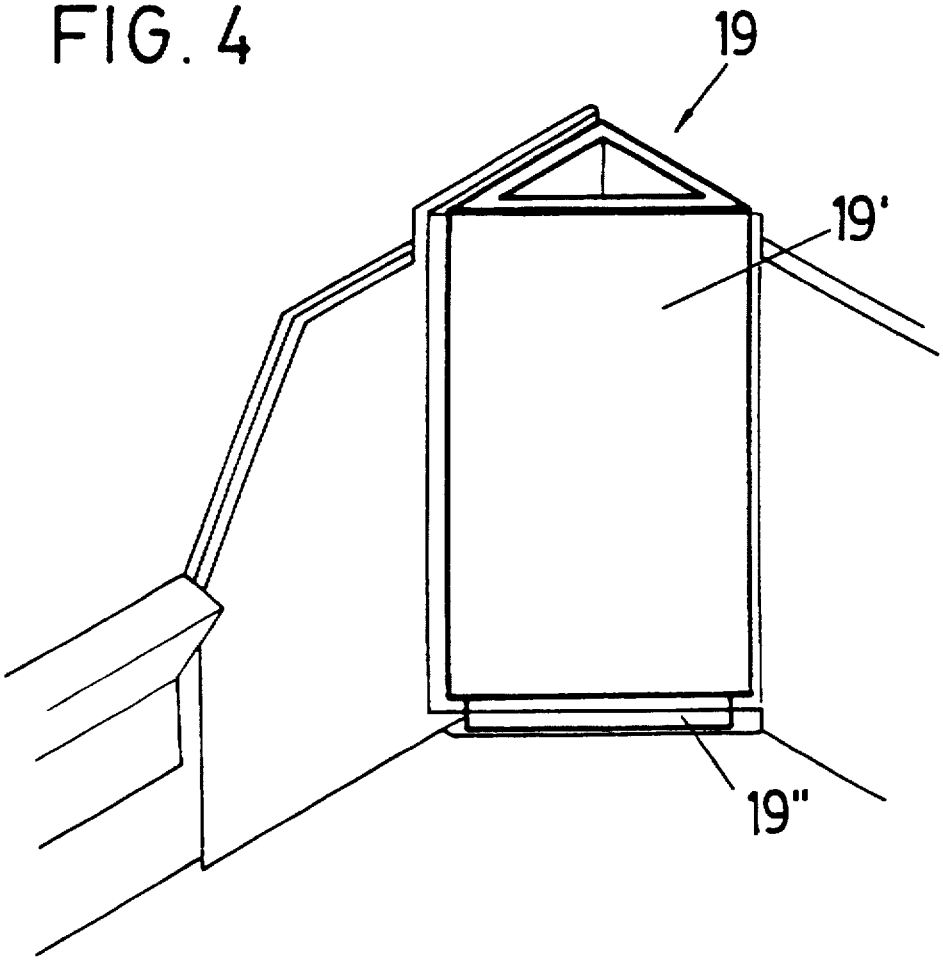
FIG. 4 shows a detailed view of the reinforcement support incorporated to the inner hollow space of the prismatic portions.

In the light of these figures, it is apparent that the cardboard container which is the object of the invention is formed from a base sheet (1) which presents side walls (2) and front walls (3) with lateral laps (4), and respective reinforcement front walls (5) independent from the base sheet (1) which are attached to the front walls (3) of the box.

The reinforcement front walls (5) being composed of a central sheet (6) laterally divided by three folding lines which define two sectors, namely an inner (7) and an outer (8) sector, said outer sector (8) having a lap (9) extending therefrom.

Said lap presents a slight staggering of their upper edge up to a level below in which an oblique cut is located in correspondence to an upper vertex of the lap.

It being foreseen that the inner (7) and outer (8) sectors form, upon assembling the reinforcement front wall (5), a prismatic reinforcement section which enhances the piling up strength, the inner sector (7) being positioned in the corner in an oblique arrangement, and the outer sector (8) being adhered to the zone which presents the upper step of the lap (9).

Upon mounting the assembly, the central sheet (6) of the reinforcement front wall (5) is adhered to the front wall (3), and lap (9) of the reinforcement front wall (5) adheres to the inner face of the lateral lap (4) of front wall (3), the external side of which is attached to the inner face of side wall (2), the prismatic portions formed by sectors (7) and (8) projecting upwards.

The side walls (2) present respective cuts (12) extending inwards from their upper edge and shaped as an equilateral triangle between whose vertices extends a folding line (13) parallel to which two other folding lines (14) and (15) run outwards, thus defining three sectors, the first of which, located between the inner folding lines (13) and (14), constitutes the upper lateral edge (16) of the box; the next sector (17) is likewise slantingly folded inwards; and the following sector (18) is adhered to the inner face of front wall (2).

The base sheet (1) shows triangular cuts (10) in each corner thereof which coincide with the position of the prismatic reinforcement portions and are designed to facilitate the piling up of the boxes.

Furthermore, said sheet presents, along the line separating the side wall (2) from the base, respective openings (11) shaped like a rhombus which allow for the ventilation of the products contained in the box.

Also, it must be pointed out that the front walls (3), coinciding with the reinforcement front walls (5), are provided with partially circular central cutouts (11) along their upper edge which allow the box to be handled with ease.

For special piling up requirements, reinforcement supports or columns (19) are optionally provided which coincide in length with the height of the hollow spaces (20) of the prismatic portions, said supports (19) being shaped to have an ample upper sector (19') of a constant hollow triangular section which constitutes the female portion designed to receive the reinforcement support of the box piled above it, and another lower, compact and likewise triangular sector (19") with a surface smaller than that of the upper sector, which acts as the male portion.

This description need not be more extensive for the expert on the subject to understand the scope of the invention and the advantages deriving therefrom.

The materials, the shape, the size and the arrangement of the elements are liable to changes provided the essence of the invention is not altered.

I claim:

1. A cardboard container for the transport and storage of products which comprises:

a base sheet with, two side walls, two front walls with lateral laps, extending therefrom and separated by folding lines, two reinforcement front walls independent from the base sheet and attached to said front walls, each reinforcement front wall being composed of a central sheet laterally divided by three folding lines which define an inner sector, an outer sector, and a lap extending from said outer sector, said lap consists on an inner zone and an outer zone, said inner zone presents its upper edge staggered up to a level below corresponding to said outer zone, said inner sector being positioned in an oblique arrangement and said outer sector being adhered to said inner zone of said lap, forming a prismatic reinforcement portion with a hollow inside.

2. A cardboard container according to claim 1, wherein said outer zone of the lap incorporates an oblique cut located in correspondence to an upper vertex of said lap.

3. A cardboard container according to claim 1, wherein said central sheet of the reinforcement front wall is adhered to the front wall, said lap of the reinforcement front wall adheres to the inner face of the lateral lap of front wall, and the outer face of the lateral lap of front wall is attached to the inner face of side wall.

4. A cardboard container according to claim 1, wherein the prismatic portions formed by the inner sector and the outer sector project upwards above the upper edge of the front walls.

5. A cardboard container according to claim 1, wherein the side walls present respective cuts extending inwards from their upper edge and shaped to form an equilateral triangle between whose vertices extends an inner line parallel to which an intermediate and an outer folding lines and run outwards, thus defining three sectors, the first of which, contained between the inner folding line and the intermediate folding line constitutes the upper lateral edge of the box; the next sector contained between the inner folding line and the intermediate folding line is likewise slantingly folded inwards; and the following sector contained between the intermediate folding line and the outer folding line is adhered to the inner face of side wall, thus providing a mean for holding and transporting the container.

6. A cardboard container according to claim 1 wherein the base sheet comprises triangular cuts in each of the corners thereof which coincide with the position of the prismatic portions for facilitating the piling up of the boxes.

7. A cardboard container according to claim 1 wherein reinforcement supports are introduced into the hollows of the reinforcement portions, said reinforcement supports coincide in length with the height of the hollow of the prismatic portions, said reinforcement supports being shaped to have an ample upper sector of a constant hollow triangular section which constitutes the female portion designed to receive another reinforcement support of the box to be piled above it, and another lower, compact and triangular sector with a surface smaller than that of the upper sector, which acts as the male portion.

8. A cardboard container according to claim 1 wherein the front walls, coinciding with the reinforcement front walls, are provided with partially circular central cutouts along their upper edge which allow the box to be handled with ease.

9. A cardboard container according to claim 1 wherein the folding lines that separate the side wall from the base sheet are provided with openings in the form of a rhombus which allow for the ventilation of the products contained in the box.

* * * * *